US007351764B2

(12) United States Patent
Shevchenko et al.

(10) Patent No.: US 7,351,764 B2
(45) Date of Patent: Apr. 1, 2008

(54) METHODS TO ENHANCE BRIGHTNESS OF PULP AND OPTIMIZE USE OF BLEACHING CHEMICALS

(75) Inventors: Sergey M. Shevchenko, Aurora, IL (US); Prasad Y. Duggirala, Naperville, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 10/814,969

(22) Filed: Mar. 31, 2004

(65) Prior Publication Data

US 2005/0217813 A1 Oct. 6, 2005

(51) Int. Cl.

| | |
|---|---|
| ***C09K 15/32*** | (2006.01) |
| ***C09K 3/10*** | (2006.01) |
| ***C01B 15/02*** | (2006.01) |
| ***D21C 9/12*** | (2006.01) |
| ***D06L 3/02*** | (2006.01) |

(52) U.S. Cl. ..... 524/556; 252/186.29; 252/186.41; 252/389.22; 252/400.22; 423/272; 423/273; 162/76; 162/79

(58) Field of Classification Search ..... 562/10; 524/556; 423/272, 273; 252/389.22
See application file for complete search history.

(56) References Cited

U.S. PATENT DOCUMENTS

| | | | | |
|---|---|---|---|---|
| 3,668,123 | A * | 6/1972 | Steinberg et al. | 507/109 |
| 4,238,282 | A * | 12/1980 | Hyde | 162/76 |
| 4,372,813 | A * | 2/1983 | Clerbois et al. | 162/48 |
| 4,487,655 | A | 12/1984 | Nöetzel et al. | |
| 4,614,646 | A * | 9/1986 | Christiansen | 423/272 |
| 4,732,650 | A * | 3/1988 | Michalowski et al. | 162/17 |
| 4,880,566 | A * | 11/1989 | Baehr et al. | 252/389.22 |
| 5,013,404 | A | 5/1991 | Christainsen et al. | |
| 5,145,558 | A | 9/1992 | Christiansen et al. | |
| 5,372,610 | A * | 12/1994 | Kahle et al. | 8/111 |
| 6,258,207 | B1 * | 7/2001 | Pan | 162/27 |
| 6,702,921 | B2 * | 3/2004 | Duggirala et al. | 162/70 |

FOREIGN PATENT DOCUMENTS

| | | | |
|---|---|---|---|
| CA | 1174810 | 9/1984 | 162/72 |
| DE | 19528843 A1 | 2/1997 | |
| JP | 4-114853 | 11/1993 | |
| JP | 1998-246021 | 8/1998 | |

OTHER PUBLICATIONS

"DTMPA-A New Sequestrant For Silicate-Free Bleaching of Paper Pulp with Hydrogen Peroxide", (abstract Only), Jun. 16-19, 1981; p. 21, EUCEPA Intern. Mech. Pulping Conf., Oslo by B.H. May.

* cited by examiner

*Primary Examiner*—Duane Smith
*Assistant Examiner*—Ives Wu
(74) *Attorney, Agent, or Firm*—Michael B. Martin

(57) ABSTRACT

Mechanical or Chemical pulp is treated with about 0.01 weight % to about 5 weight % of a Mixture. The Mixture is water; diethylenetriaminepentakis(methyl)phosphonic acid or its known salts; polyacrylic acid or its known salts; and optionally one or more inert compounds. This Mixture acts to either maintain the brightness level of the pulp at the target level or to increase the brightness level of the pulp. In addition the Mixture allows for maintaining the pulp at the target level of brightness even when the amounts of other ingredients, such as hydrogen peroxide, hydrosulfite, sodium silicate and magnesium, that are typically added to the pulp, are reduced.

10 Claims, No Drawings

METHODS TO ENHANCE BRIGHTNESS OF PULP AND OPTIMIZE USE OF BLEACHING CHEMICALS

FIELD OF THE INVENTION

This invention relates generally to pulp and paper making, and more particularly to brightness enhancing for peroxide and hydrosulfite bleaching of pulp.

BACKGROUND OF THE INVENTION

There are three major types of pulping methods known in the Pulp and Paper Industry. The first is chemical and the second is mechanical and the third is a combination of chemical and mechanical. Methods to enhance the effectiveness of all three types of pulping methods are always desirable.

In chemical pulps, sufficient lignin is dissolved to allow the fibers to separate with little, if any mechanical action. However, a portion of the lignin remains with the fiber and an attempt to remove this during digestion would result in excess degradation of the pulp. The degradation is a depolymerization of the cellulose and is measured by determining the viscosity of the cellulose dissolved in special solvents. For this reason from about 3 wt. % lignin to about 4 wt. % lignin is normally left in hardwood chemical pulps and from about 4 wt. % to about 10 wt. % lignin is normally left in softwood chemical pulps after the cook or digestion. The lignin is subsequently removed by bleaching in separate pulp mill operations if completely delignified and whitened pulps are to be produced.

The dominant chemical wood pulping process is the kraft ("kraft" means strength in German) or sulfate process. In the kraft process, the alkaline pulping liquor or digesting solution contains about a 3 to 1 ratio of sodium hydroxide and sodium sulfide. A stronger pulp is obtained when sodium sulfide is used in combination with sodium hydroxide. This is to be compared with pulp obtained when sodium hydroxide is used alone, as it was in the original soda process. In the kraft process the wood is delignified (pulped) with a solution of sodium hydroxide and the addition of sodium sulfide is beneficial for pulping as well. Key advantages of the kraft process is its great adaptability of pulping many different species of wood and yielding pulps that may be used for a variety of applications.

Another type of chemical pulping is the "sulfite process". The sulfite process has several advantages over the kraft process. These advantages include improved yield (45-55%), lower cost cooking chemicals, higher brightness pulps and more easily bleached pulps. However, the sulfite method also has two distinct disadvantages: only a limited number of species can be pulped and the pulps produced are distinctly weaker than those made using the kraft or sulfate process.

In mechanical pulping, pulp is made predominantly using mechanical methods. The fundamental criteria used in assessing the quality of mechanical pulp is the amount of energy expended per unit of production. Because this energy is difficult to quantify, pulp freeness is most commonly used as a process control parameter. Generally, the more the energy expenditure the lower the freeness of the pulp.

The first step in the mechanical pulping process is the grinding or refining of wood.

The Stone Groundwood (SGW) process involves making pulp by pressing logs and chips against an abrasive rotating surface. Many years ago the grinding surface used was an actual stone. In current practice specifically designed "artificial pulp stones" are available for the grinding.

A Pressurized GroundWood (PGW) process is where the grinding operation is completely pressurized.

Another type of mechanical pulping is Refiner Mechanical Pulp (RMP) featuring atmospheric refining with no pretreatment of the wood chips.

Thermo Mechanical Pulping (TMP) is a mechanical pulping process that evolved from RMP and a high temperature process known as the Apslund process. Thermo Refiner Mechanical Pulping (TRMP) is a variation in Thermo Mechanical Pulping. In this case, the chips are preheated under pressure and refining is carried out at atmospheric pressure. TMP and TRMP pulps are stronger than either SGW or RMP pulps.

The third type of pulping process is a combination of chemical and mechanical pulping processes. Two types of combination processes are ChemiMechanical Pulping and SemiMechanical Pulping. There is little difference between ChemiMechanical Pulping (CMP) and SemiChemical Mechanical Pulping (SCMP). Both processes involve pretreatment of chips with chemicals, followed by mechanical refining. Four different chemical treatments are associated with these processes. These chemical treatments are: sodium hydroxide, sodium bisulfite, sodium sulfite, acid or its known salts sulfite treatment. These processes are generally used on hardwoods. Chemical treatment weakens the fiber structure allowing fibers to rupture similarly to softwood that is mechanically pulped.

ChemiThermoMechanical Pulping (CTMP) appears to be a full evolution of all Mechanical pulping methods. It includes chemical treatment elevated temperature steaming followed by mechanical refining. This process can produce fibrous raw materials that vary considerably in properties depending upon process conditions such as sodium sulfite concentration, pH, temperature, etc.

With all pulps, "pulp brightness" is a measurement of the ability of a sample to reflect monochromatic (457 nm) light as compared to a known standard, using magnesium oxide (MgO). Since cellulose and hemicellulose are white, they do not contribute to pulp color. It is generally agreed that the lignin left in the pulp after pulping is responsible for the color the pulp. This unbleached pulp has an appearance similar to brown grocery bags. The chromophores are believed to be quinone-like materials formed from the lignin's phenolic groups through an oxidative mechanism. Additionally, heavy metal ions, especially iron and copper, can form colored complexes with the phenolic groups.

There are generally two approaches to removing color. The first, typical of processing of mechanical pulps, uses a selective chemical to destroy the chromophores but not the lignin. The other approach, typical of processing chemical pulps, uses a bleaching system to remove the residual lignin. The bleaching of pulp is the standard method of removing color from pulp. It is current state of the art technology for all chemical and mechanical pulps to be bleached.

In chemical pulp, the bleaching of pulp and the subsequent delignification of pulp is usually performed in several chemical stages, with each stage being referred to by a letter designation. Note, that although all pulps are bleached, only chemical pulps are delignified using oxygen treatment.

The following table briefly describes the most common stages in a "typical" chemical bleaching process. Note that the stages captured in this table are not necessarily in the order that they are practiced. For example, oxygen delignification is typically never the last step in the process as oxygen delignification leaves the pulp yellowish in color. That is why oxygen delignification is followed by some level of bleaching.

| Stage | Description |
|---|---|
| C—chlorination | Reaction with $Cl_2$ in an acid or its known salts medium |
| E—Extraction | Dissolution of chlorination reaction products with sodium hydroxide |
| or $E_O$ | Adding oxygen with the sodium hydroxide to improve delignification and lower the use of chlorine and chlorine dioxide |
| or $E_{OP}$ | Adding oxygen and peroxide with the sodium hydroxide to improve delignification and lower the use of chlorine and chlorine dioxide |
| H—Hypochlorite | Reaction with sodium hypochlorite in alkaline medium, used to bleach both chemical and mechanical pulps |
| Y—Hydrosulfite | Reaction with sodium hydrosulfite in mildly acetic--neutral conditions, used to bleach mechanical pulps |
| D—Chlorine Dioxide | Reaction with $ClO_2$ in an acid or its known salts medium |
| P—Peroxide | Reaction with peroxides in an alkaline medium |
| O—Oxygen | Reaction with $O_2$ at high pressure in an alkaline medium. Usually used prior to chlorine as a delignification step. |
| $D_C$ or $C_D$ | Mixture of chlorine and chlorine dioxide |

Five or six stages are needed to produce a "full bleach" brightness level of 89 to 91% MgO. Most commonly these stages, in order are CEDED, CEHDED and OCEDED. A brightness of 65% MgO can be obtained with less stages, usually a CEH. Intermediate brightness levels can be reached using CED, CEHH, CEHD, or CEHP. Brightness enhancement during bleaching of pulp, as well as improving selective lignin removal during oxygen delignification of the chemical (kraft) pulp is important in the pulp and paper industry. Brightness enhancement is also useful in mechanical pulps.

It is to be understood that separate from the technical aspects of bleaching pulp there are environmental concerns that have dictated that chlorination has been almost entirely eliminated in favor of alternative treatments.

In current practice in pulp and paper mills, mechanical pulps are not oxygen delignified.

Currently, hydrogen peroxide is the dominant bleaching agent for mechanical pulps. Sodium hydrosulfite is also used for bleaching. It is known that hydrogen peroxide and hydrosulfite gradually decompose during the process due to unproductive side reactions catalyzed by transitional metal ions. Therefore, metal management through chelation is considered a key to increased brightness.

Several auxiliary chemicals are needed to provide an adequate performance. These auxiliary chemicals include sodium silicate for stability and chelation, sodium hydroxide for alkalinity, chelating agents such as ethylenediaminetetraacetic acid or its known salts (EDTA) and diethylenetriamine pentaacetic acid or its known salts (DTPA) for control of transition metals, and magnesium sulfate for cellulose stability. Each chemical added increases the cost of the bleaching method. High loads of bleaching chemicals can often cause downstream problems in papermaking.

Although the benefits of using a chelant are known in the pulp and paper industry, the known chelants used in hydrogen peroxide bleaching:

(1) are usually selective in regards of the target transition metal ions (e.g., removing manganese but not iron or vice versa);

(2) must be applied in substantial quantities to achieve a noticeable effect; and (3) require washing out complexes formed during the treatment.

Selectivity, as it applies in oxygen delignification, is defined as the ratio of the change in delignification (kappa number that characterizes lignin removal; the lower the better) divided by the change in viscosity (that characterizes carbohydrate depolymerization, the higher the better). Currently, the commonly used chemical for increasing the selectivity of oxygen delignification is magnesium sulfate. Magnesium sulfate does not influence the delignification, but provides a small measure of protection for the pulp viscosity. Conventional chelants such as DTPA and EDTA are also used for this purpose, however, none of them are reported to affect the kappa number. Therefore, currently, there are no known additives that can provide a noticeable improvement in lignin removal during oxygen delignification.

Japanese Patent Application No. 4-114853 discloses a method of pretreatment of wood pulp before bleaching which uses certain water-soluble polymers. The desired goal is to subject wood pulp to bleaching pretreatment through inexpensive pretreatment having little toxicity, thereby permitting a high degree of bleaching of wood pulp in the subsequent bleaching step. The recommended amount of polymer used in this Japanese Patent Application is from about 0.04 to 0.8 wt % per "exsiccated" pulp.

U.S. Pat. No. 6,702,921 issued on Mar. 9, 2004 and is entitled Method To Enhance Pulp Bleaching And Delignification. This patent describes and claims a method for making a Chemical or Mechanical pulp comprising the steps of digesting wood chips in the digester(Chemical) or grinding wood chips using mechanical grinding techniques (Mechanical) to create unbleached pulp and then bleaching the pulp and optionally subjecting the pulp to pressurized oxygen delignification(only with Chemical pulps); where the improvement comprises treating the pulp with from about 0.002 weight % to about 0.02 weight % of an organic sulfide chelating agent before or during bleaching, or before optional oxygen delignification of the pulp.

It would be desirable to identify additional or alternative compounds capable of brightness enhancement during bleaching of mechanical and chemical pulp.

SUMMARY OF THE INVENTION

The first aspect of the instant claimed invention is, in a method for making chemical pulp comprising the steps of digesting wood chips in the digester to create unbleached pulp and then bleaching the pulp using peroxide as the bleaching agent, the improvement comprising treating the pulp with from about 0.01 weight % to about 5 weight % of a Mixture comprising a) from about 40 weight % to about 60 weight % water;

b) from about 20 weight % to about 95 weight % diethylenetriaminepentakis(methyl)phosphonic acid or its known salts;

c) from about 5 weight % to about 50 weight % polyacrylic acid or its known salts; and optionally d) from about 1 weight % to about 20 weight % of one or more inert compounds;

wherein said Mixture is added before or during bleaching.

The second aspect of the instant claimed invention is in a method for making mechanical pulp comprising the steps of grinding or refining wood to create unbleached pulp and then bleaching the pulp; using peroxide or hydrosulfite as the bleaching agents, the improvement comprising treating the pulp with from about 0.01 weight % to about 5 weight % of a Mixture comprising a) from about 40 weight % to about 60 weight % water;
b) from about 20 weight % to about 95 weight % diethylenetriaminepentakis(methyl)phosphonic acid or its known salts;
c) from about 5 weight % to about 50 weight % polyacrylic acid or its known salts; and optionally
d) from about 1 weight % to about 20 weight % of one or more inert compounds;

wherein said Mixture is added before or during bleaching.

The third aspect of the instant claimed invention is a composition of matter comprising a) from about 40 weight % to about 60 weight % water;
b) from about 20 weight % to about 95 weight % diethylenetriaminepentakis(methyl)phosphonic acid or its known salts;
c) from about 5 weight % to about 50 weight % polyacrylic acid or its known salts; and optionally
d) from about 1 weight % to about 20 weight % of one or more inert compounds.

DETAILED DESCRIPTION OF THE INVENTION

Throughout this patent application, the following terms have the indicated meanings.

Aldrich refers to Aldrich, P.O. Box 2060, Milwaukee, Wis. 53201.

AMP refers to aminotris(methylenephosphonic acid) or its known salts.

CAS Registry Number is the Chemical Abstracts Services Registry Number.

CMP refers to ChemiMechanical Pulping.

$$\text{Consistency} = \frac{\text{wt. in grams of oven-dry fiber}}{\text{100 grams of pulp-water Mixture}}$$

This definition of consistency is according to Tappi recommended procedure T240om-93. Throughout this patent application, consistency is stated either as a decimal number or as the equivalent percentage.

CTMP refers to ChemiThermoMechanical Pulping.

DTPA refers to diethylenetriaminepentaacetic acid or its known salts.

DTMPA refers to diethylenetriaminepentakis(methyl) phosphonic acid or its known salts.

EDTA refers to ethylenediaminetetraacetic acid or its known salts.

MgO refers to magnesium oxide.

Nalco refers to Nalco Company, 1601 W. Diehl Road, Naperville, Ill. 60563, (630) 305-1000.

PA refers to polyacrylic acid or its known salts.

PGW refers to Pressurized Groundwood pulp.

RMP refers to Refiner Mechanical Pulp.

SCMP refers to SemiChemical Mechanical Pulping.

SGW refers to Stone GroundWood pulp.

TMP refers to Thermo Mechanical Pulping.

TRMP refers to Thermo Refiner Mechanical Pulping.

Weight % means weight of active ingredient per weight of dry pulp.

The first aspect of the instant claimed invention is, in a method for making chemical pulp comprising the steps of digesting wood chips in the digester to create unbleached pulp and then bleaching the pulp using peroxide as the bleaching agent, the improvement comprising treating the pulp with from about 0.01 weight % to about 5 weight % of a Mixture comprising a) from about 40 weight % to about 60 weight % water;
b) from about 20 weight % to about 95 weight % diethylenetriaminepentakis(methyl)phosphonic acid or its known salts;
c) from about 5 weight % to about 50 weight % polyacrylic acid or its known salts; and optionally
d) from about 1 weight % to about 20 weight % of one or more inert compounds;

wherein said Mixture is added before or during bleaching.

Diethylenetriaminepentakis(methyl)phosphonic acid ("DTMPA") is a known chelant and is currently in use to enhance brightness in both mechanical and chemical pulp production. The instant claimed invention is the discovery that there is a synergism between DTMPA and polyacrylic acid allowing for a certain portion of the DTMPA to be replaced by polyacrylic acid with a certain amount of base being used to adjust the pH of the Mixture and the resulting Mixture can function as well as DTMPA functions by itself. This is an extremely valuable discovery because polyacrylic acid is much less expensive than DTMPA.

DTMPA is known in the art and can be obtained through known chemical supply companies. The preferred salt of DTMPA for use in the Mixture of the instant claimed invention is the sodium salt when a sodium base, such as sodium hydroxide, is used and it is the potassium salt when a potassium base, such as potassium hydroxide, is used.

Polyacrylic acid is a known chemical and can be obtained through known chemical supply houses. The preferred salt of polyacrylic acid is sodium polyacrylate when a sodium base, such as sodium hydroxide, is used and it is potassium polyacrylate when a potassium base, such as potassium hydroxide, is used.

One product method to make the Mixture of the instant claimed invention, is as follows: blend DTMPA (55.9% as a raw material containing 47% DTMPA) and polyacrylic acid or its known salts (24.5% as a raw material containing 46% polyacrylic acid or its known salts), and any commercially available base, such as sodium hydroxide, potassium hydroxide, calcium chloride and the like. The preferred base is sodium hydroxide(19.6% as a raw material containing 50% NaOH).

The resulting product is a mildly acidic, water-based product Mixture comprising a) from about 40 weight % to about 60 weight % water;
b) from about 20 weight % to about 95 weight % diethylenetriaminepentakis(methyl)phosphonic acid or its known salts;
c) from about 5 weight % to about 50 weight % polyacrylic acid or its known salts; and optionally
d) from about 1 weight % to about 20 weight % of one or more inert compounds.

The preferred formula of the Mixture comprising a) about 50 weight % water;
b) about 29 weight % diethylenetriaminepentakis(methyl) phosphonic acid or its known salts;
c) about 14 weight % polyacrylic acid or its known salts; and optionally
d) about 7 weight % of one or more inert compounds.

The Mixture may be prepared as described by a person of ordinary skill in the art of chemistry.

When sodium hydroxide is used as a base, the inert compounds are typically selected from the group consisting of sodium chloride, sodium sulfate and ammonium sodium sulfate. When potassium hydroxide is used as a base, the inert compounds are typically selected from the group consisting of potassium chloride, potassium sulfate and ammonium potassium sulfate.

In producing the Mixture, it is important to keep in mind that hydrosulfite bleaching is conducted at a slightly acidic pH and it is known that peroxide bleaching in conducted in a strongly alkaline environment; therefore the preferred option for the Mixture applied is to use sufficient base to render the Mixture as close to neutral as possible in the pulp to which it is applied. If the pH is too low or too high, then the pH of the bleach liquor may be affected, thus reducing brightness.

A neutral product is also preferred to lessen the possibility that the product itself could cause or contribute to corrosion in the metal equipment used in the pulp process.

The inert compounds present in the Mixture are typically salts and sulfates, either present in small quantities in the original DTMPA or its known salts or in the polyacrylic acid and its known salts or in the base used. For example, when sodium hydroxide is used as the base, then typically the inert materials present include sodium chloride, sodium sulfate and ammonium sulfate. The inert compounds present in the Mixture do not contribute to the activity of the Mixture for this application.

It has been found that when this Mixture is added to chemical pulp that it works to either maintain or slightly enhance the brightness of the pulp, if nothing else is changed about the chemicals added to the pulp. Or the Mixture can be used to maintain the brightness of the pulp while amount(s) of other chemicals typically added are reduced.

This Mixture also works to either enhance or maintain the brightness of recycled pulp, wherein the recycled pulp comprises chemical pulp or a blend of chemical and mechanical pulp.

As an alternative benefit of having added the instant claimed Mixture to chemical pulp, it is known that the amount of bleaching chemical(s), such as hydrogen peroxide can be replaced by the Mixture. Replacing some of the bleaching chemical(s), with the Mixture, allows a pulp and paper company to reduce production costs while achieving the target brightness in the chemical pulp.

As an alternative benefit of having added the instant claimed Mixture to chemical pulp, it is known that the amount of magnesium added to the chemical pulp can be reduced, when the Mixture is added to the chemical pulp, because use of the Mixture has been found to improve viscosity similarly to magnesium, but at much lower dose. This also provides another beneficial effect because magnesium appears to have a detrimental effect on brightness while the Mixture improves brightness. Replacing some of the magnesium with the Mixture, allows a pulp and paper company to reduce production costs and reduce the overall amount of magnesium present, while achieving the target brightness in the chemical pulp.

In certain situations, with certain chemical pulps and always as an optional step, Chemical pulps are subjected to pressurized oxygen delignification before or during the overall bleaching process. Pressurized oxygen delignification takes place using a liquor containing sodium hydroxide with pressurized oxygen. In a preferred version of this embodiment, the liquor includes an additive such as an organic phosphonate and/or a surfactant.

Delignification is also known as "lignin removal" and is characterized by the kappa number of the pulp. The kappa number of the pulp is the volume, usually reported in ml of 0.1N potassium permanganate solution consumed by one gram of moisture-free pulp under the conditions specified in TAPPI Method T236om-99. The kappa number is linearly proportional to the amount of residual lignin in the pulp. The Pulp viscosity is determined by the capillary viscometer method, TAPPI Method T23om-99.

It has been found that when the Mixture is added to a Chemical pulp prior to pressurized oxygen delignification, that the delignification is enhanced. The same Mixture that is useful in improving brightness is also useful in enhancing oxygen delignification. Relatively speaking the same amount of the Mixture is used to enhance oxygen delignification as is used to enhance brightness.

A preferred embodiment of the instant claimed invention is that amount of DTMPA in the Mixture that yields the same brightness value as does the use of DTMPA by itself.

The Mixture has been found to work effectively both in peroxide, including $E_{OP}$ process, bleaching of Chemical pulp and in peroxide and hydrosulfite bleaching of Mechanical pulp. As mentioned previously, the Mixture can also be used to enhance oxygen delignification.

The Mixture is recommended to be applied either in pre-treatment or directly into bleach liquor for maximum performance. The amount of Mixture applied is from about 0.01 weight % to about 5 weight % of the pulp. The preferred amount of Mixture is from about 0.10 weight % to about 1 weight %. The most preferred amount of Mixture is about 0.20 weight %.

The preferred embodiment of the instant claimed invention is having the minimal amount of DTMPA used in the Mixture while still achieving the same or an acceptable level of brightness in the pulp. As has been previously discussed, with some pulps, it has been found that by using the Mixture, and not changing the amounts or type of any of the other additives to the pulp that the brightness value of the chemical pulp is increased.

The second aspect of the instant claimed invention is in a method for making Mechanical pulp comprising the steps of grinding or refining wood to create unbleached pulp and then bleaching the pulp; using peroxide or hydrosulfite as the bleaching agents, the improvement comprising treating the pulp with from about 0.01 weight % to about 5 weight % of a Mixture comprising a) from about 40 weight % to about 60 weight % water;
b) from about 20 weight % to about 95 weight % diethylenetriaminepentakis(methyl)phosphonic acid or its known salts;
c) from about 5 weight % to about 50 weight % polyacrylic acid or its known salts; and optionally
d) from about 1 weight % to about 20 weight % of one or more inert compounds;

wherein said Mixture is added before or during bleaching.

The Mechanical pulp can be one of several types including SGW and PGW pulp, RMP, TMP and TRMP.

The Mixture suitable for use in this second aspect of the instant claimed invention are the same as those listed for use in the first aspect of the instant claimed invention.

The Mixture is recommended to be applied either in pre-treatment or directly into bleach liquor for maximum performance. The amount of Mixture applied is from about 0.01 weight % to about 5 weight % of the pulp. The preferred amount of Mixture is from about 0.10 weight % to about 1 weight %. The most preferred amount of Mixture is about 0.2 weight %.

The preferred embodiment of the instant claimed invention is having the minimal amount of DTMPA used in the Mixture while still achieving the same or an acceptable level of brightness in the pulp. As has been previously discussed, with some pulps, it has been found that by using the Mixture, and not changing the amounts or type of any of the other additives to the pulp that the brightness value of the mechanical pulp is increased.

It has been found that when this Mixture is added to mechanical pulp that it works to either maintain or slightly enhance the brightness of the pulp, if nothing else is changed about the chemicals added to the pulp. Or the Mixture can be used to maintain the target brightness of the pulp while amount(s) of other chemicals typically added are reduced.

This Mixture also works to either enhance or maintain the brightness of recycled pulp, wherein the recycled pulp comprises mechanical pulp or a blend of chemical and mechanical pulp.

As an alternative benefit of having added the instant claimed Mixture to mechanical pulp, it is known that the amount of bleaching chemical can be reduced. This means, if desired, that at least some of the expensive bleaching chemical(s), such as hydrogen peroxide and hydrosulfite, which are both used in the bleaching of Mechanical pulp, can be replaced by the Mixture. Replacing some of the expensive bleaching chemical(s), such as hydrogen peroxide and hydrosulfite with the Mixture, allows a pulp and paper company to reduce production costs while maintaining an acceptable level of brightness in the mechanical pulp.

As an alternative benefit of having added the instant claimed Mixture to mechanical pulp, it is known that the amount of other chelating compounds, such as EDTA can be reduced. Replacing some of the EDTA with the Mixture, allows a pulp and paper company to reduce production costs and reduce the overall amount of EDTA present, while maintaining an acceptable level of brightness in the mechanical pulp.

This Mixture also works when added to mechanical pulp, wherein the total amount of sodium silicate present in the pulp is reduced. It has been found that even with the total amount of sodium silicate reduced in the mechanical pulp, use of this Mixture allows the target brightness for the mechanical pulp to be achieved.

This Mixture also works when added to mechanical pulp, wherein the total amount of both sodium silicate and peroxide present in the pulp is reduced. It has been found that even with the total amount of both sodium silicate and peroxide reduced in the mechanical pulp, use of this Mixture allows the target brightness for the mechanical pulp to be achieved.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

EXAMPLES

In these Examples, the acronym "EXAMDTMPA" refers to an aqueous solution with 47% DTMPA in the mixture and the acronym "EXAMPAA" refers to an aqueous solution with 46% polyacrylic acid. In each of these Examples, sufficient base, with the base being sodium hydroxide as an aqueous 50% solution of NaOH was added to achieve appropriate pH for the Mixture being tested. All percentages in these examples are given on a weight percent dry pulp basis. Brightness is a term used to describe the whiteness of pulp on a scale: from 0%, meaning absolute black, to 100%, relative to MgO standard, which has an absolute brightness of ca. 96%; by the reflectance of blue light (457 mm) from the paper produced from the pulp.

In each of these examples, Competitive Product A is DTPA plus undefined phosphonates.

The acronym "PREFMIX" refers to a Mixture with the following composition:

a) about 50 weight % water;

b) about 29 weight % sodium diethylenetriaminepenta (methylene phosphonate);

c) about 14 weight % sodium acrylate;

d) about 7 weight % of one or more inert compounds, wherein the inert compounds are sodium chloride, ammonium sodium sulfate and sodium sulfate.

Bleaching conditions for these examples

Peroxide Bleaching

Test 1. Pulp: Pulp Mill Blue, TMP, 4.5%. Bleaching: 70° C., 1 hr, 10% consistency, 2% NaOH, 2.5% $H_2O_2$.

Test 2. Pulp: Pulp Mill Red, PGW, 8.2%. Bleaching: 70° C., 1 hr, 10% consistency, 1.5% NaOH, 2.0% $H_2O_2$.

Test 3. Pulp: Pulp Mill Green, TMP 29.7%. DI water was used to adjust consistency. Bleaching: 65° C., 1 hr, 10% consistency, 1.5% NaOH, 2% $H_2O_2$.

Test 4. Pulp: Pulp Mill Orange, PGW, 7.9%. Pretreatment (samples 1-5 only): 15 min, 50° C., 2% consistency, tap water. Bleaching: 70° C., 1 hr, 10% consistency, 2% NaOH, 2.5% $H_2O_2$.

Hydrosulfite Bleaching

Test 1. Pulp: Pulp Mill Purple, cTMP, 10.3%. Bleaching: 75° C., 1.5 hr, bottles, under nitrogen, 5% consistency, 1% sodium hydrosulfite.

Test 2. Pulp: Pulp Mill Yellow, cTMP, 10.3%. Mill white water added to get 4% consistency. Bleaching: 60° C., 30 min, bottles, under nitrogen, 4% consistency, 1% sodium hydrosulfite.

$E_{OP}$ Process, Peroxide Stage

Test 1. Pulp: Pulp Mill Brown, kraft hardwood pulp (aspen), 35.7%. Bleaching: 85° C., 1.5 h, 10% consistency, 1.3% NaOH, 0.1% $MgSO_4$, 0.4% or 1% $H_2O_2$. Mill water was used to adjust consistency.

Test 2. Pulp: Pulp Mill Brown, kraft hardwood pulp (maple), 34.5%. Bleaching: 85° C., 1.5 hr, 10% consistency, 1.3% NaOH, 0.1% MgSO4, 0.4% or 1% $H_2O_2$. Mill water was used to adjust consistency.

Test 3. Pulp: Pulp Mill Lime Green, kraft 16.3%. DI water was used to adjust consistency. Bleaching: 75° C., 1 hr 15 min, 10% consistency, 1.8% NaOH, 0.75% $H_2O_2$.

Example I

Performance of EXAMDTMPA/EXAMPA Blends at Different Component Ratios

Throughout these test results an asterisk * symbol on a line means that the work reported on that line is a Comparative Example, NOT an example of the Instant Claimed Invention. "Control" means no chemicals present in the pulp except the bleaching chemicals as described for each type of bleaching.

TABLE 1

(Peroxide Bleaching, PGW, Test 2)

| Bleaching | R 457 Brightness | E 313 Yellowness |
|---|---|---|
| Control* | 75.10 | 14.17 |
| 0.1% EXAMDTMPA* | 76.66 | 13.60 |
| 0.091% EXAMDTMPA + 0.0091% EXAMPAA (1:0.1) | 76.71 | 13.51 |
| 0.083% EXAMDTMPA + 0.0167% EXAMPAA (1:0.2) | 76.83 | 13.12 |
| 0.0714% EXAMDTMPA + 0.0286% EXAMPAA (1:0.4) | 76.62 | 13.56 |
| 0.0625% EXAMDTMPA + 0.0375% EXAMPAA (1:0.6) | 76.35 | 12.98 |

TABLE 2

(Hydrosulfite, cTMP, Test 2)

| Bleaching | R 457 Brightness | E 313 Yellowness |
|---|---|---|
| Control* | 62.41 | 17.89 |
| 0.2% EDTA* | 63.40 | 18.31 |
| 0.2% EXAMDTMPA* | 63.25 | 18.51 |
| 0.1% EXAMDTMPA* | 63.15 | 18.51 |
| 0.083% EXAMDTMPA + 0.0167 EXAMPAA | 63.32 | 18.28 |
| 0.083% EXAMDTMPA + 0.0167 EXAMPAA | 63.34 | 18.30 |

TABLE 3

(Peroxide, PGW, Test 2)

| Bleaching | R 457 Brightness | E 313 Yellowness |
|---|---|---|
| Control* | 77.81 | 13.07 |
| 0.1% EXAMDTMPA* | 78.83 | 12.57 |
| 0.0909% EXAMDTMPA + 0.0091% EXAMPAA (1:0.1) | 78.60 | 12.57 |
| 0.087% EXAMDTMPA + 0.013% EXAMPAA (1:0.15) | 78.73 | 12.76 |
| 0.0833% EXAMDTMPA + 0.0167% EXAMPAA (1:0.2) | 78.47 | 12.69 |
| 0.08% EXAMDTMPA + 0.02% EXAMPAA (1:0.25) | 78.68 | 12.58 |
| 0.0769% EXAMDTMPA + 0.0231% EXAMPAA (1:0.30) | 78.76 | 12.70 |
| 0.074% EXAMDTMPA + 0.026% EXAMPAA (1:0.35) | 78.73 | 12.61 |
| 0.0714% EXAMDTMPA + 0.0286% EXAMPAA (1:0.4) | 78.74 | 12.73 |
| 0.069% EXAMDTMPA + 0.031% EXAMPAA (1:0.45) | 78.72 | 12.66 |
| 0.0667% EXAMDTMPA + 0.0333% EXAMPAA (1:0.5) | 78.69 | 12.41 |
| 0.1% EXAMPAA* | 77.49 | 12.49 |

Example II

Performance of PREFMIX

TABLE 4

(Peroxide, PGW, Test 2)

| Bleaching | R 457 Brightness | E 313 Yellowness |
|---|---|---|
| Control* | 77.38 | 13.19 |
| 0.1% EXAMDTMPA* | 78.45 | 12.84 |
| 0.1% PREFMIX | 78.44 | 12.60 |

TABLE 5

($E_{OP}$, peroxide stage, kraft, Test 1)

| Bleaching | Dose, % | $H_2O_2$, % | R 457 Brightness | E 313 Yellowness |
|---|---|---|---|---|
| Control* | | 0.4 | 83.02 | 6.65 |
| DTPA* | 0.2 | 0.4 | 83.09 | 6.27 |
| PREFMIX | 0.2 | 0.4 | 84.18 | 6.20 |
| PREFMIX | 0.1 | 0.4 | 83.98 | 6.02 |
| Control* | | 1 | 85.16 | 4.42 |
| DTPA* | 0.2 | 1 | 85.75 | 4.53 |
| PREFMIX | 0.2 | 1 | 85.81 | 4.03 |
| PREFMIX | 0.1 | 1 | 86.02 | 4.13 |

TABLE 6

($E_{OP}$, peroxide stage, kraft, Test 2)

| Bleaching | Dose, % | $H_2O_2$, % | R 457 Brightness | E 313 Yellowness |
|---|---|---|---|---|
| Control* | | 0.4 | 83.20 | 7.67 |
| DTPA* | 0.2 | 0.4 | 83.61 | 7.77 |
| PREFMIX | 0.2 | 0.4 | 83.71 | 7.48 |
| Control* | | 1 | 84.85 | 6.51 |
| DTPA* | 0.2 | 1 | 84.97 | 6.20 |
| Competitive Product A* | 0.2 | 1 | 85.11 | 6.55 |
| PREFMIX | 0.2 | 1 | 85.74 | 5.92 |
| PREFMIX | 0.1 | 1 | 85.27 | 6.08 |

TABLE 7

($E_{OP}$, peroxide stage, kraft, Test 3): MgSO4 added to the pulp at pH 2.85 prior to the bleach liquor

| Bleaching | Viscosity at 25 C., cps | Standard Deviation | R 457 Brightness | Standard Deviation |
|---|---|---|---|---|
| Control* | 13.7 | 0.8 | 73.5 | 0.3 |
| O.45% $MgSO_4$* | 14.7 | 0.5 | 72.8 | 0.2 |
| 0.05% PREFMIX | 14.6 | 0.9 | 73.9 | 0.1 |

TABLE 8

($E_{OP}$, peroxide stage, kraft, Test 3): MgSO4 added to the bleach liquor

| | R 457 Brightness | Standard Deviation | E 313 Yellowness | Standard Deviation |
|---|---|---|---|---|
| Control* | 73.5 | 0.01 | 15.4 | 0.13 |
| 0.45% $MgSO_4$* | 71.4 | 0.09 | 17.1 | 0.01 |
| 0.1% PREFMIX | 74.5 | 0.06 | 14.5 | 0.08 |
| 0.05% PREFMIX | 74.3 | 0.17 | 14.7 | 0.04 |

TABLE 9

(Peroxide, PGW, Test 4, see Test 4 write-up for information on consistency)

| Bleaching | R 457 Brightness | E 313 Yellowness |
|---|---|---|
| Control* | 79.90 | 11.51 |
| 0.05% PREFMIX | 80.84 | 11.40 |
| 0.1% PREFMIX | 80.48 | 11.35 |
| 0.1% PREFMIX | 80.95 | 11.17 |
| 0.05% Competitive Product A | 80.55 | 11.63 |
| Control* | 79.01 | 12.52 |
| 0.1% PREFMIX | 80.47 | 11.60 |

TABLE 9-continued

| (Peroxide, PGW, Test 4, see Test 4 write-up for information on consistency) | | |
|---|---|---|
| Bleaching | R 457 Brightness | E 313 Yellowness |
| 2.5% Silicate* | 80.42 | 11.67 |
| 1% Silicate* | 79.94 | 11.84 |
| 1% Silicate + 0.1% PREFMIX | 80.34 | 11.62 |
| 1% Silicate + 0.1% Competitive Product A* | 79.82 | 11.87 |

*Comparative Example

Example III

Reduction of Other Chemicals Added to the Pulp

Application of the Mixture, in the form of PREFMIX allows the mill to achieve goals beyond brightness enhancement, such as reduction of silicate (less downstream problems, reduced expenses) and hydrogen peroxide (reduced expenses).

TABLE 10

| (Peroxide, TMP) 70° C., 1 hr, 10% consistency, 2% NaOH, 2.5% $H_2O_2$ | | |
|---|---|---|
| Bleaching | R457 Brightness | E313 Yellowness |
| Control* | 59.40 | 21.24 |
| 0.2% Competitive Product A* | 60.91 | 20.73 |
| 0.2% PREFMIX | 62.38 | 20.68 |
| 0.2% DTPA* | 62.54 | 20.14 |

TABLE 11

| (Peroxide, PGW) 70° C., 1 hr, 10% consistency, 1.5% NaOH, 2% $H_2O_2$ | | |
|---|---|---|
| Bleaching | R457 Brightness | E313 Yellowness |
| Control* | 75.92 | 14.06 |
| 0.2% Competitive Product A* | 77.08 | 13.60 |
| 0.2% PREFMIX | 77.49 | 13.35 |
| 0.2% DTPA* | 76.82 | 13.73 |
| Control* | 75.43 | 14.09 |
| 0.2% Competitive Product A* | 76.28 | 13.75 |
| 0.1% PREFMIX | 77.07 | 13.14 |
| 0.1% DTPA* | 76.48 | 13.76 |

TABLE 12

| (Peroxide, recycle) - silicate reduction 80° C., 1 hr, 10% consistency, 0.65% NaOH, 0.5% $H_2O_2$ | |
|---|---|
| Bleaching | R457 Brightness |
| Control* | 81.42 |
| 0.2% PREFMIX | 81.53 |
| 0.907% silicate (as techn. sol.)* | 82.48 |
| 0.680% silicate (75%)* | 81.94 |
| 0.680% silicate + 0.1% PREFMIX | 82.75 |
| 0.680% silicate + 0.05% PREFMIX | 82.26 |

TABLE 13

| (Hydrosulfite, PGW) - EDTA replacement 70° C., 1.5 hr, 5% consistency, under nitrogen, 1% sodium hydrosulfite | | |
|---|---|---|
| Bleaching | R457 Brightness | E313 Yellowness |
| Control* | 70.54 | 14.99 |
| 0.166% EDTA* | 72.14 | 15.76 |
| 0.1% PREFMIX | 72.37 | 15.37 |
| 0.166% PREFMIX | 73.10 | 15.49 |

TABLE 14

| (Hydrosulfite, cTMP) - EDTA replacement 60° C., 0.5 hr, 4% consistency, under nitrogen, 1% sodium hydrosulfite | |
|---|---|
| Bleaching | R457 Brightness |
| Control* | 62.41 |
| 0.2% EXAMDTMPA* | 63.25 |
| 0.1% PREFMIX | 63.34 |

TABLE 15

| (Peroxide, recycle) - peroxide reduction 70° C., 1 hr, 10% consistency, 1.5% NaOH, 1.1% sodium silicate | | |
|---|---|---|
| % $H_2O_2$ | R457 Brightness, 0.1% PREFMIX | R457 Brightness, 0.2% Competitive Product A |
| 3 | 79.93 | 78.41 |
| 2.5 | 79.99 | 78.94 |
| 2.25 | 79.84 | 78.24 |
| 2 | 79.53 | 78.46 |
| 1.75 | 78.82 | 77.79 |
| 1.5 | 77.37 | 76.76 |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

The invention claimed is:

1. A synergistic mixture for enhancing the brightness of bleached pulp consisting of a) about 50 weight % water;

b) about 29 weight % diethylenetriaminepentakis(methyl) phosphonic acid or its known salts;

c) about 14 weight % polyacrylic acid or its known salts;

d) base for pH adjustment; and e) about 7 weight % of one or more inert compounds.

2. The synergistic mixture of claim 1 wherein said diethylenetriaminepentakis(methyl)phosphonic acid or its known salts is sodium diethylenetriaminepentakis(methylene)phosphonate.

3. The synergistic mixture of claim 1 wherein said polyacrylic acid or its known salts is sodium polyacrylate.

4. The synergistic mixture of claim 1 wherein said inert compounds are selected from the group consisting of sodium sulfate, ammonium sodium sulfate and sodium chloride.

5. The synergistic mixture of claim 4 wherein the inert compounds contained in said composition comprise at least about 4.5 weight % sodium chloride, about 0.25 weight % ammonium sodium sulfate and about 2.25 weight % sodium sulfate.

6. A composition comprising a) about 50 weight % water;

b) about 29 weight % diethylenetriaminepentakis(methyl) phosphonic acid or its known salts;

c) about 14 weight % polyacrylic acid or its known salts; and d) about 7 weight % of one or more inert compounds.

7. The composition of claim 6 wherein said diethylenetriaminepentakis(inethyl)phosphonic acid or its known salts is sodium diethylenetriaminepentakis(methylcne)phosphonate.

8. The composition of claim 6 wherein said polyacrylic acid or its known salts is sodium polyacrylate.

9. The composition of claim 6 wherein said inert compounds are selected from the group consisting of sodium sulfate, ammoniu2m sodium sulfate and sodium chloride.

10. The composition of claim 9 wherein the inert compounds contained in said composition comprise at least about 4.5 weight % sodium chloride, about 0.25 weight % ammonium sodium sulfate and about 2.25 weight % sodium sulfate.

* * * * *